US007347124B1

(12) United States Patent
Kravitch

(10) Patent No.: US 7,347,124 B1
(45) Date of Patent: Mar. 25, 2008

(54) DRIVE TOOL WITH UNIVERSAL JOINT HEAD

(76) Inventor: Nick C. Kravitch, 418 State Route 151, Aliquippa, PA (US) 15001

( * ) Notice: Subject to any disclaimer, the term of this patent is extended or adjusted under 35 U.S.C. 154(b) by 0 days.

(21) Appl. No.: 11/403,474

(22) Filed: Apr. 13, 2006

(51) Int. Cl.
*B25B 17/00* (2006.01)
*B25B 13/46* (2006.01)

(52) U.S. Cl. ..... 81/57.29; 81/57.27

(58) Field of Classification Search ..... 81/57.29, 81/57.26, 57.27, 64
See application file for complete search history.

(56) References Cited

U.S. PATENT DOCUMENTS 1,325,407 A * 12/1919 Morgan ..... 81/57.29
1,526,502 A * 2/1925 Pilger, Jr. ..... 81/57.29
2,796,101 A * 6/1957 Hasemann et al. ..... 81/64
2,814,322 A * 11/1957 Kupfrian ..... 81/64
3,111,049 A * 11/1963 Brehmer ..... 81/57.26
3,696,694 A * 10/1972 Boro ..... 81/57.27
3,972,252 A * 8/1976 Hunter ..... 81/57.29
4,262,561 A * 4/1981 Mize ..... 81/57.29
4,455,896 A * 6/1984 Holmes ..... 81/57.26
4,680,994 A * 7/1987 Singleton ..... 81/57.29
4,748,872 A * 6/1988 Brown ..... 81/57.26
4,913,007 A * 4/1990 Reynolds ..... 81/57.29
5,455,997 A * 10/1995 Nasiell ..... 29/456
6,651,532 B1 * 11/2003 Whitelock et al. ..... 81/57.29
6,813,975 B2 * 11/2004 Kozak ..... 81/177.6

* cited by examiner

*Primary Examiner*—David B Thomas
(74) *Attorney, Agent, or Firm*—Price & Adams

(57) ABSTRACT

In accordance with the present invention there is provided a drive tool assembly that includes a shaft having a drive end portion and a driven end portion with a longitudinal axis extending therebetween. The shaft driven end portion is flexible relative to the shaft drive end portion to permit displacement of the shaft driven end portion in an arcuate path relative to the shaft drive end portion. A torque transmitting mechanism is drivingly connected to the shaft driven end portion. Means is provided for supporting the torque transmitting mechanism on the shaft driven end portion for transmission of torque from the shaft drive end portion through the shaft driven end portion to the torque transmitting mechanism as the shaft driven end portion is displaced from the shaft drive end portion in an arcuate path along the longitudinal axis.

20 Claims, 8 Drawing Sheets

DRIVE TOOL WITH UNIVERSAL JOINT HEAD

BACKGROUND OF THE INVENTION

1. Field of the Invention

This invention relates to a drive tool and, more particularly, to an apparatus and method for performing operations in limited space work areas.

2. Description of the Prior Art

Many working environments include inaccessible or limited space work areas, such as subterranean keyhole excavation spaces, underground vaults, sewers, tanks, storage bins, diked areas, vessels, silos, and other confined spaces. A confined space generally has limited or restricted means of entry or exit. A confined space is accessible to workers to the extent that it is large enough to enter and perform assigned work and is not designed for continuous occupancy. The hazards associated with a confined space may include storage of hazardous material, usage of hazardous material, hazardous activities or other activities associated with the external environment.

Many workplaces contain spaces that meet the regulatory definitions of a confined space because their configurations impede the activities of workers who must enter and exit the space to perform work. Also, workers encounter workplaces where work is to be performed in a space that is completely inaccessible to the extent that the workers must operate tools from a position remote from or out of the inaccessible area. In many instances, a worker will face increased risk of serious physical injury, entrapment engulfment, exposure to hazardous materials, or hazardous atmospheres. Hazardous atmospheres include atmospheres that include flammable, toxic, irritating, or corrosive components.

Some confined spaces are "permit-required" confined spaces. Permit-required confined spaces may contain or have the potential to contain a hazardous atmosphere. Permit-required confined spaces may also contain a material that has the potential to engulf an entrant. Permit-required spaces may also have an internal configuration that might cause an entrant to be trapped or asphyxiated by inwardly converging walls or by a floor that slopes downward and tapers to a smaller cross section. Permit-required confined spaces may contain any other recognized serious safety or health hazards.

The need to minimize disruption to the surrounding landscape has led to the development of minimally invasive technology or subterranean "keyhole" excavations. Subterranean keyhole excavation involves performing work above ground using extension tools to access valves, couplings, and the like on a subterranean natural gas pipeline or water line. The objective of subterranean keyhole excavation is to perform as much work underground in a confined space with the smallest possible ground opening. A small opening is cut in the pavement so that earthen material around the pipe is excavated to provide access to a particular section of the pipeline. The target holes are typically 18 inches in diameter but may be as small as 12 inches in diameter. Typically, a valve or some fixture is replaced or repaired. These operations are performed by using tools that extend through the keyhole to the underground pipeline.

The tools used in keyhole operations require manipulation by extension rods. The tool is used to access the equipment, such as a wrench, pipe cutter, cleaning tool, or grinding tool mounted on the end of an extension rod. Conventionally the tools are mounted at right angles on the extension rods. Because the tool is fixed in its angular position, it cannot be adjusted to engage the equipment if the right angle mounted tool can not be aligned with the equipment. For example, in the case of a ratchet used to disassemble a value on a pipeline in a keyhole operation, the ratchet must be mounted on the end of an extension tube. With the ratchet connected to the extension tube it may be difficult to align the ratchet drive at a right angle with a nut or a bolt on the valve. The ratchet on the end of the tube may not line up with the valve or coupling connection.

Most conventional wrenches use a left to right swinging motion to function. This motion is limited or prohibited in keyhole operations. In most cases, rotation and vertical up and down motion are the only motions available in keyhole operations. Therefore, there is a need in keyhole operations for a tool that generates rotation about the vertical axis to operate tools that transmit rotation from right perpendicular to left perpendicular of the vertical axis. In addition there is need for a tool that overcomes the problems of misalignment in transmitting rotation along a longitudinal axis to an axis perpendicular thereto.

Various extension tools have been disclosed for performing conventional torque transmitting operations. In one example, U.S. Pat. No. 5,396,820 discloses an extensible wrench handle having a removable wrench head. The handle includes a tubular member with a telescoping portion extending therefrom. The telescoping portion is connected to the tubular member through a conventional fastening mechanism. The wrench head is pivotally attached to the telescoping portion.

U.S. Patent Application Publication No. 2006/0000320 discloses a ratchet tool assembly for underground work having an elongated handle member, a elongated release rod, a plate assembly, a ratchet mount plate, a rotatable shaft, a toothed ratchet, and a wrench head. The wrench head includes teeth that engage a bolt head, nut or the like on an underground pipe. The release rod is mounted on the handle member which carries a plate assembly. A ratchet mount plate is pivotally mounted by a rotatable shaft to the plate assembly. Rotation of the shaft generates rotation of the ratchet. The release rod, shaft, and ratchet cooperate to drive the wrench head to engage the bolt head, nut, or the like on the pipe.

U.S. Pat. No. 1,903,660 discloses a flexible wrench having a rotatable shaft mounted within a housing. The shaft has a tee-handle on one end and engages a plurality of extension elements on the opposite end. The shaft rotates the extension elements so that the extension elements rotate a socket element.

U.S. Pat. No. 4,907,476 discloses a socket wrench having an extended tubular casing that supports a gear shaft. The socket wrench also includes the rotatable shaft, a bevel gear, a bevel pinion, a tubular casing, a housing, and a drive shaft. The rotatable shaft includes a tee-handle mounted thereon. The shaft is mounted within the casing, and the shaft rotates the bevel gear which rotates the bevel pinion. The bevel pinion rotates the drive shaft to in turn rotate the wrench head.

U.S. Pat. No. 3,847,039 discloses a valve stem rotating head having a worm wheel mounted within a housing. The head is connected to a rotating shaft which engages the worm wheel to rotate a countershaft that extends into a hole within the ground. The countershaft engages a joint to rotate a socket that engages a valve stem within the hole.

U.S. Patent Application Publication No. 2000/0134674 discloses a hydraulic power tool for servicing pipes. The tool includes a hydraulic motor or swivel housing attached to an extensible mounting frame. A rotatable shaft extends from the frame in a perpendicular direction into a hole in the ground. A pair of flexible air hoses are attached to the shaft.

U.S. Pat. No. 5,570,581 discloses a hydraulic valve operator mounted on a sectional frame. The frame includes a frame section that extends from the back of a pick-up truck bed. A hydraulic motor is mounted on the frame section. A drive rod extends through the hydraulic motor so that the drive rod is perpendicular to the frame section. The hydraulic motor rotates the drive rod which extends into a hole in the ground where the drive rod engages an underground valve.

U.S. Pat. No. 3,972,506 discloses a device for opening and closing a valve. The device includes a powered valve opening and closing unit, a flexible rotary shaft, and a worm gear. The shaft is rotated in driving engagement with the worm gear to in turn open and close the valve.

U.S. Pat. No. 3,585,885 discloses an adjustable tool handle having a pair of terminal fittings that are connected to one another with a flexible tension member. The tension member includes a plurality of tubular components. The terminal fitting can be connected to a wrench head.

U.S. Pat. No. 4,730,960 discloses a flexible socket extension. The extension includes a pair of end caps that are connected by a flexible cable. One of the end caps engages a female connector, such as a socket.

While it is known to use drive tools that are extended into limited space work areas, and inaccessible work areas, such as areas excavated in keyhole operations, there is need for a drive tool that can extend into a limited space work area for transmitting rotation to equipment on a pipeline through a range of angles which are not limited to 90°. Even though the drive tool is mounted at a 90° angle relative to the shaft of the extension tool, the angular position of the drive tool must be adjustable so as to overcome misalignment problems with the equipment on the pipeline.

SUMMARY OF THE INVENTION

In accordance with the present invention there is provided a drive tool assembly that includes a shaft having a drive end portion and a driven end portion with a longitudinal axis extending therebetween. The shaft driven end portion is flexible relative to the shaft drive end portion to permit displacement of the shaft driven end portion in an arcuate path relative to the shaft drive end portion. A torque transmitting mechanism is drivingly connected to the shaft driven end portion. Means is provided for supporting the torque transmitting mechanism on the shaft driven end portion for transmission of torque from the shaft drive end portion through the shaft driven end portion to the torque transmitting mechanism as the shaft driven end portion is displaced from the shaft drive end portion in an arcuate path along the longitudinal axis.

Further in accordance with the present invention there is provided a method for performing operations in a limited space work area that includes the steps of extending a shaft along a longitudinal axis into a limited space work area with a shaft drive end positioned outside of the limited space work area and a shaft driven end positioned in the limited space work area. A torque transmitting device is drivingly connected to the shaft driven end. The torque transmitting device is supported on the shaft driven end for arcuate movement with the shaft driven end relative to the shaft drive end. The shaft drive end is rotated to transmit rotation from outside of the limited space work area to the shaft driven end and the torque transmitting device in the limited space work area. Rotation is transmitted to the torque transmitting device in the limited space work area as the shaft driven end is displaced along the longitudinal axis in an arcuate path.

In addition the present invention is directed to a drive tool for operating in a limited space work area that includes a shaft extending longitudinally from a drive end positioned outside of the limited space work area to a driven end positioned within the limited space work area. The shaft driven end includes a flexible portion to allow bending of the shaft driven end portion along an arcuate path in the limited space work area relative to the shaft drive end positioned outside of the limited space work area. Torque transmitting apparatus is drivingly connected to the flexible portion of the shaft driven end and is movable in an arcuate path with the shaft driven end. A device is connected to the shaft drive end for rotating the shaft in the limited space work area to transmit rotation from the flexible portion of the shaft driven end along the arcuate path to the torque transmitting apparatus.

Accordingly, a principal object of the present invention is to provide a drive tool with a universal joint head for transmitting rotation along an arcute path to a tool positioned within a limited space work area, as well as in an inaccessible work area.

Another object of the present invention is to provide a tool for use in keyhole operations for transmitting rotation about a vertical axis from above ground to below ground to a fixture or the like on a pipeline where rotation about the vertical axis is transmitted from either right perpendicular to left perpendicular of the vertical axis.

A further object of the present invention is to provide a drive tool having a universal head for use in keyhole operations that permits a ratchet mounted on the end of an extension tube to move through an arc to engage a fixture on a underground pipeline to overcome misalignment of the drive tool with the fixture.

An additional object of the present invention is to provide in limited space work areas, such as keyhole operations and inaccessible work areas a drive tool that is angularly movable to allow adjustments in the position of a socket drive of the tool to a connection on a pipeline so that the socket drive can engage a fixture on a pipeline at an angle displaced from an angle perpendicular to the fixture.

These and other objects of the present invention will be more completely disclosed and described in the following specification, accompanying drawings, and appended claims.

DESCRIPTION OF THE PREFERRED EMBODIMENTS

Figure 1:
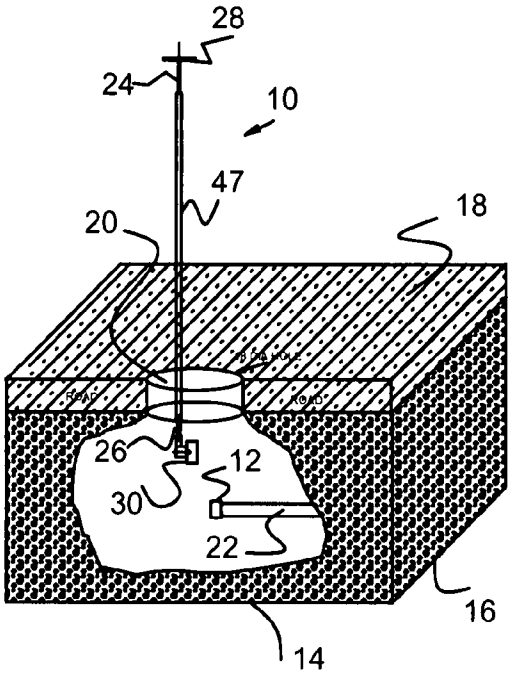
FIG. 1 is a schematic isometric view of a drive tool with a universal joint head extended through an opening in a limited space work area for engaging a fixture on the end of an underground pipeline.

Referring to the drawings and particularly to FIGS. 1-8, there is illustrated a drive tool assembly generally designated by the numeral 10 for use to perform remote operations on a work piece 12 positioned within a cavity 14 in a subterranean formation 16 below a pavement 18. A hole 20 is cut in the pavement 18 as encountered in carrying out a keyhole operation for maintenance and repair of the work piece 12 as part of an underground pipeline 22. It should also be understood in accordance with the present invention that the cavity 14 is also an inaccessible work area not permitting workers to enter the area, requiring workers to manipulate the drive tool 10 remote of the work area. The drive tool 10 is provided in unassembled, modular form as a kit shown in FIGS. 7 and 8. The drive tool 10 is assembled from the components of the kit to perform operations on the work piece 12 in the cavity 14 of the subterrarian formation 16 through the opening 20 cut in the pavement 18.

Figure 2:
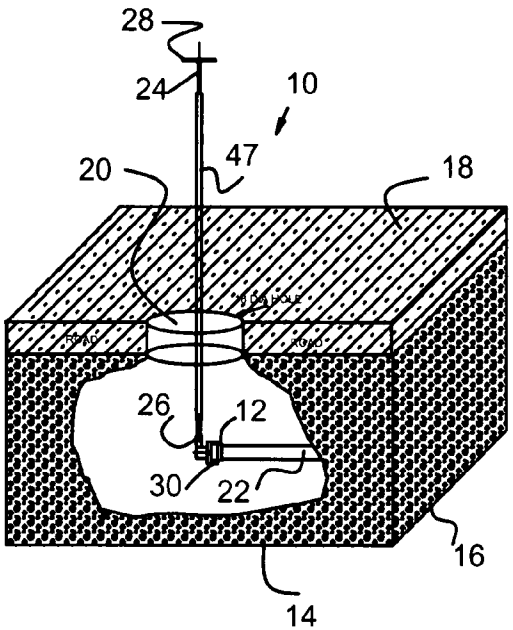
FIG. 2 is a schematic isometric view of the drive tool shown in FIG. 1, illustrating the tool engaged to the fixture at an angle perpendicular to a vertical axis on the end of the underground pipeline.
Figure 3:
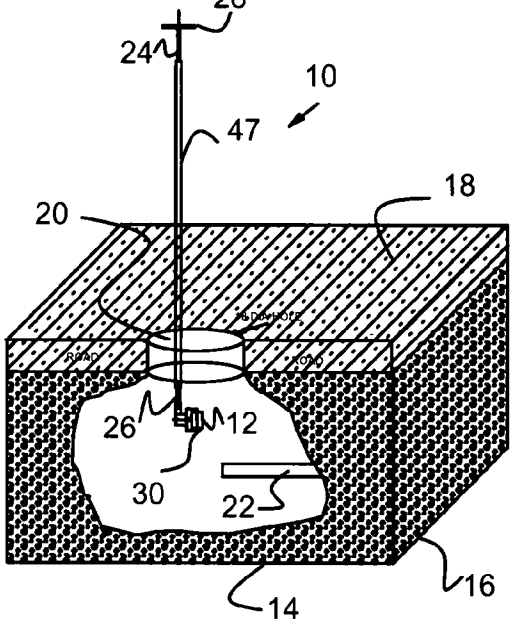
FIG. 3 is an isometric view of the drive tool shown in FIG. 1, illustrating the fixture on the end of the pipeline removed by the drive tool and raised with the drive tool out of the limited space work area.

As shown in FIGS. 1-3, the drive tool assembly 10 is lowered through the opening 20 into the cavity 14 to engage the work piece 12 mounted on the end of the pipeline 22. In the embodiment shown in FIGS. 1-3, the work piece 12 is an end cap on the pipeline 22. In other embodiments it includes a variety of fixtures, such as a valve, a gate, or any other similar device connected to a subterrarian natural gas pipeline or water line 22 positioned within the subterrarian formation 16. The cavity 14 is a limited space work area, such as a permit-required confined space, a keyhole excavation or any other similar confined space or an inaccessible work area.

As shown in FIGS. 1-3, the drive tool assembly 10 includes a drive end 24 and a driven end 26. The drive end 24 is positioned above the pavement 18 for manipulation by a manipulating device, such as tee handle 28 that extends from the drive end 24. The driven end 26 is positioned below the pavement and is extended through the opening 20 into the cavity 14 where the pipeline 22 is located. The drive end 24 transmits rotation and a vertical up and down movement from the handle 28 to the driven end 26. A tool 30 is attached to the driven end 26 for performing a selected operation on the work piece 12.

The tool assembly 10 is lowered through the opening 20 into the cavity 14 with the attached tool 30. The handle 28 of the assembly 10 is manipulated to move the tool 30 into engagement with the work piece 12. As will be explained later in greater detail, the angular position of the tool 30 on the driven end 26 with respect to the longitudinal axis of the assembly 10 is displaceable in a arcuate path so that the tool 30 can engage the work piece 12 when the work piece 12 is misaligned from a right angle position with respect to the tool 30. As shown in FIGS. 1-3, the tool 30 engages the work piece 12 where the tool 30 and work piece 12 are in a right angle relationship, as compared to the alignment of the tool 30 and work piece 12 shown in FIGS. 18-20 and 21-23. Once the tool 30 engages the work piece 12 as shown in FIG. 2, the handle 28 is rotated to transmit rotation to the tool 30 to rotate a cap in the form of the work piece 12 from the end of the pipeline 22. As seen in FIG. 3, once the cap is disengaged from the pipeline 22, the drive tool assembly 10 and attached cap are raised vertically out of the cavity 14 through the opening 20.

Figure 4:
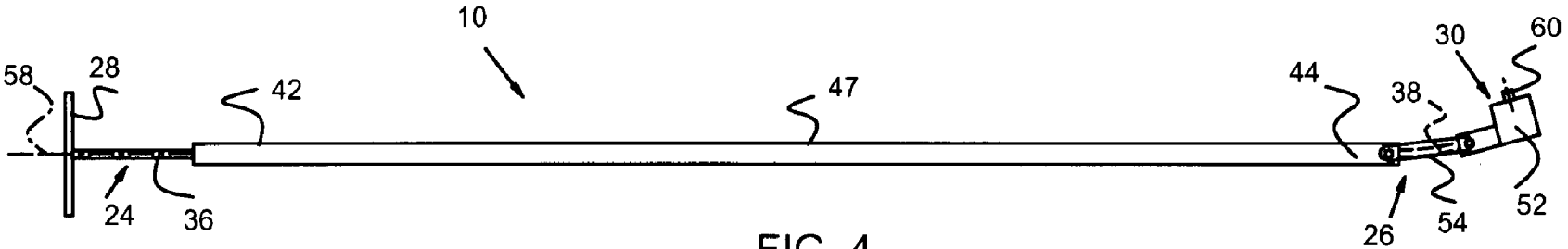
FIG. 4 is a plan view of the drive tool, shown in FIGS. 1-3 illustrating a drive end having a tee-handle and a driven end mounted on a universal joint in a position angularly displaced from the drive end.
Figure 5:
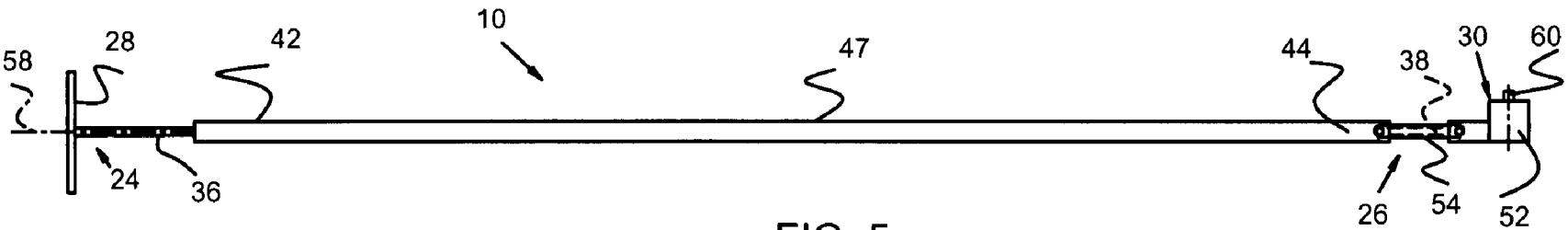
FIG. 5 is a is a plan view of the drive tool shown in FIG. 4, illustrating the driven end coaxially aligned with the drive end.
Figure 6:
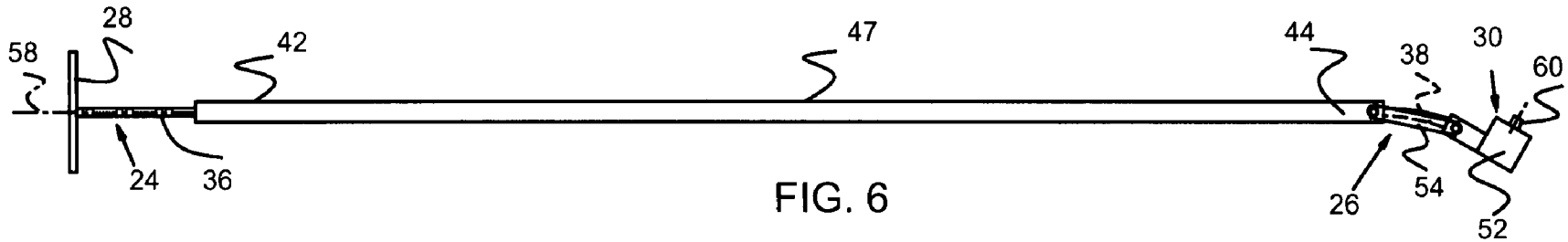
FIG. 6 is a plan view of the drive tool shown in FIG. 4, illustrating a further position of the driven end angularly displaced from the drive end.
Figure 7:
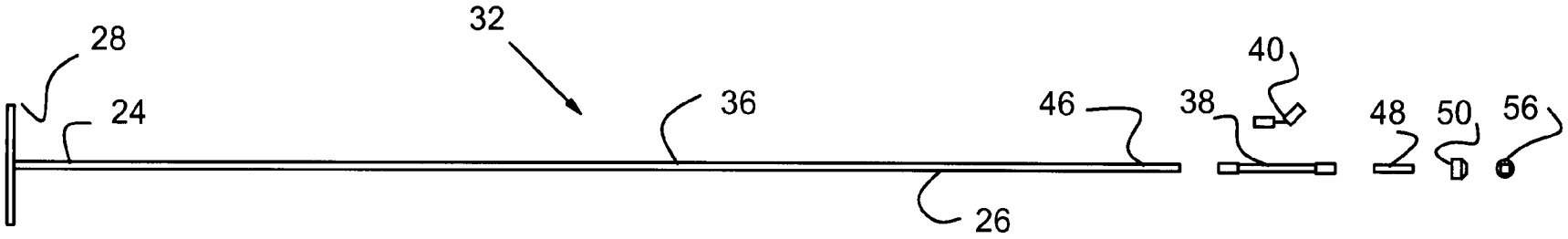
FIG. 7 is a top plan exploded view of the drive shaft for the drive tool of the present invention, illustrating universal connections for mounting a drive tool on the end of the shaft.
Figure 8:
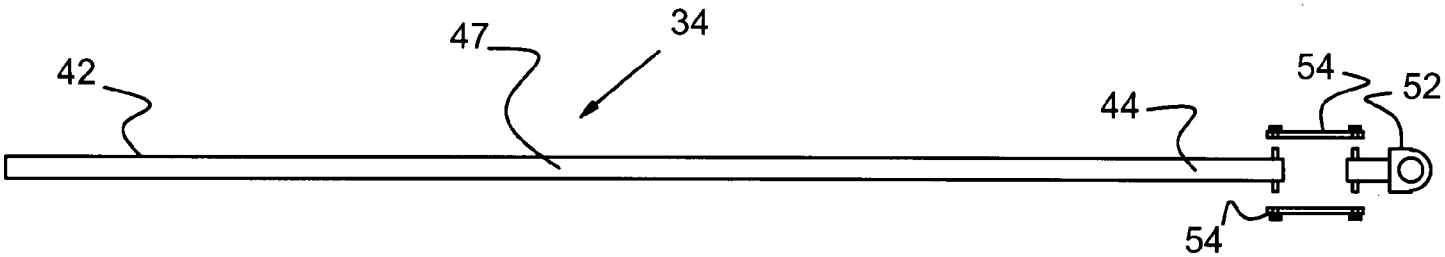
FIG. 8 is top plan exploded view of the housing for supporting the drive shaft shown in FIG. 7 for the assembled drive tool.

Referring now to FIGS. 7 and 8, there is illustrated a kit for assembling the drive tool assembly 10 that includes a first kit component generally designated by the numeral 32 in FIG. 7 and a second kit component generally designated by the numeral 34 in FIG. 8. In this respect the kit components 32 and 34 being in modular form facilitate ease of assembly and disassembly of the drive tool assembly 10. FIGS. 4-6 illustrate the drive tool assembly 10 constructed from assembly of the kit components 32 and 34 shown in FIGS. 7 and 8.

The kit component 32 preferably includes a shaft member 36 fabricated from any suitable material to allow for transmission of rotation along its longitudinal axis. As illustrated in FIG. 7 and additionally in FIGS. 9-14, the shaft member 36 includes a flexible extension 38 selectively, nonrotatably connected to the end of shaft member 36. An example of a commercially available product suitable for use as the flexible shaft extension 38 is an Elliot Flexible Shaft manufactured and sold by the Elliot Manufacturing Co. of Binghampton, N.Y. The flexible shaft extension 38 is particularly suited for rotational operations where the tool 30 on the end of the shaft 36 is displaced from or is out of axial alignment with the work piece. In other words, a right angle relationship does not exist between the longitudinal axis of the shaft member 36 and the axis of the work piece 12 on the pipeline 22. This misalignment is shown for the pipeline installations in FIGS. 18-20 and 21-23.

The flexible shaft extension 38 shown in FIG. 7 includes in one embodiment an Elliot Flexible Shaft connected to the end of shaft member 36. In another embodiment shown in FIG. 7, a conventional universal joint 40 serves as a flexible extension of the shaft member 36. The universal joint 40 is nonrotatably connected to the shaft end portion 46. With these two embodiments, the shaft member 36 is provided with a flexible extension 38, 40 to allow displacement of the tool 30 along an arcuate path of the shaft longitudinal axis.

As illustrated in FIG. 8, the kit component 34 includes a longitudinal housing 47 to receive the drive shaft 36 with the tee handle 28 extending from housing end portion 42. The drive shaft 36 extends through the housing 47 and out of the housing end portion 44 to where the drive shaft 36 is connected to either the flexible shaft 38 or the universal joint 40. The flexible shaft 38 or universal joint 40 is drivingly connected to a gear shaft 48 of a bevel drive gear 50. As shown in detail in FIGS. 9-11, the gear shaft 48 and bevel drive gear 50 are nonrotatably connected to the drive shaft end portion 46 through the flexible shaft 38. A gear housing 52 is supported by the housing end portion 44 and receives the gear shaft 48 and the bevel drive gear 50. The gear housing 52, as shown in FIGS. 4-6, is connected by a pair of link arms 54 to the shaft housing end portion 44. The link arms 54 are connected by nuts and bolts to opposed ends of the shaft housing end portion 44 and the gear housing 52. Other suitable fastening devices, such as wing nuts, can be used to connect the link arms 54 to the shaft housing 44 and the gear housing 52. The link arms 54 support the gear housing 52 on the shaft housing end portion 44 to take the weight of the gear housing 52 off of the flexible shaft 38.

As illustrated in FIGS. 9-11 and 12-14, the flexible shaft 38 is rotatably connected to the gear shaft 48 and the bevel drive gear or pinion 50. The bevel drive gear 50 meshes with a bevel gear 56 having a standard male/female driver 60 extending therefrom to form in one embodiment a standard right angle ratchet drive. By connecting the gear housing 52 to the flexible shaft 38, the bevel gear 56 is movable in an arc along the longitudinal axis of the shaft member 36 to a desired position to engage a work piece on the underground pipeline 22. The range of angular movement and oscillating movement of the gear housing 52 is schematically illustrated in FIGS. 15-23. Once the bevel gear 56 forming the ratchet drive engages a socket on a fixture, such as the end cap 12 on the pipeline 22 as shown in FIGS. 2,16,19 and 22, the tee handle 28 of the drive shaft 36 is rotated to turn the drive shaft 36 which in turn transmits torque to the meshing gears 50 and 56 and the ratchet driver 60.

Figure 9:
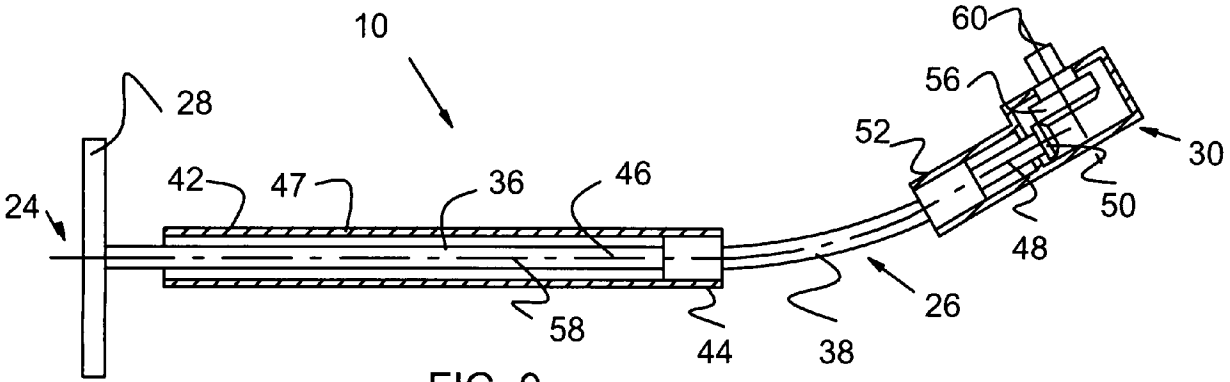
FIG. 9 is a top plan sectional view of the drive tool assembly, illustrating the drive shaft supported by a housing and having a flexible portion for transmitting rotation from the drive end to the driven end along an arcuate path.

As shown in FIGS. 4-6, the link arms 54 support the gear housing 52 on the shaft housing end portion 44 for angular movement. For clarity of illustration the link arms 54 are not shown in FIGS. 9-11. With this arrangement the gear housing 52 can articulate from axial alignment with the shaft member 36, as shown in FIGS. 9 and 11, to enable the meshing bevel gears 50 and 56 to transmit rotation to the work piece 12 where the work piece is not in a right angle alignment with the axis of shaft member 36. Once the driver 60 of the bevel gear 56 is drivingly engaged to the work piece 12 on the pipeline 22, the tee handle 28 is turned to rotate the drive shaft 36 and transmit rotation through the meshing bevel gears 50 and 56 to disengage the work piece, such as an end cap, from the pipeline 22.

Figure 10:
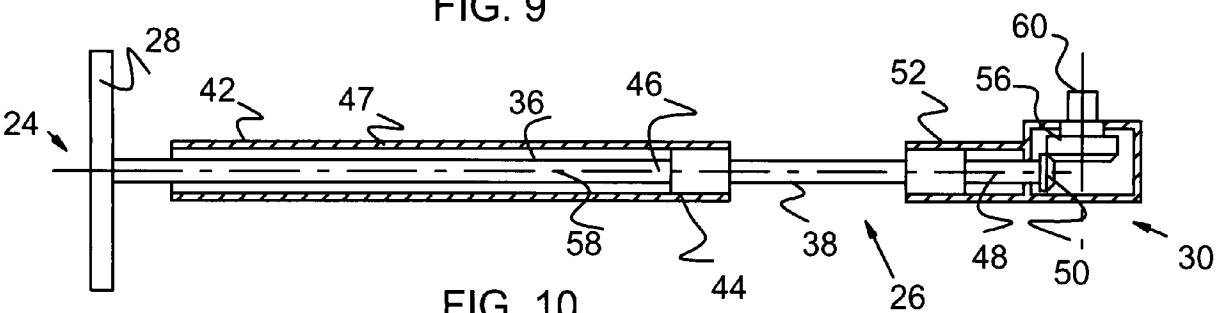
FIG. 10 is a top plan sectional view of the drive tool assembly shown in FIG. 9, illustrating axial alignment of the drive end with the driven end.
Figure 11:
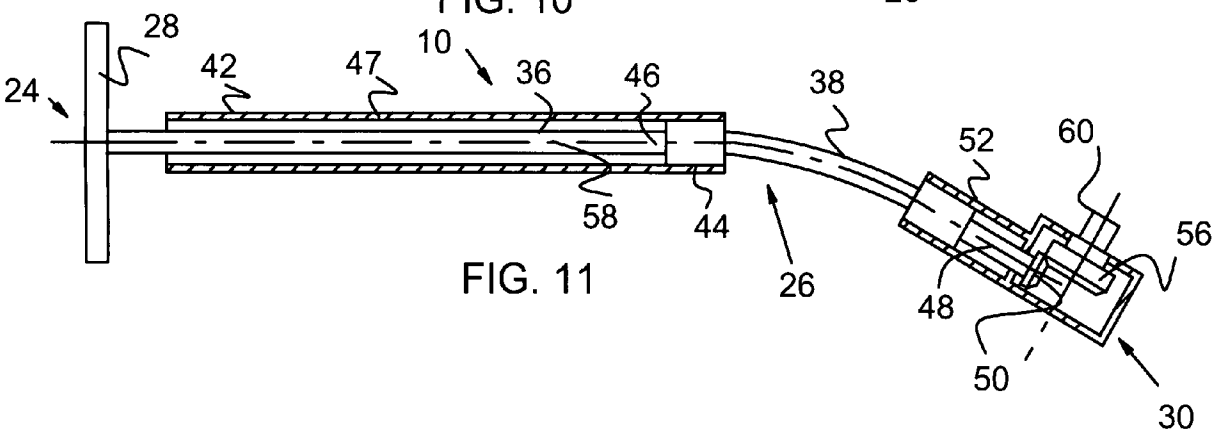
FIG. 11 is a top plan sectional view of the drive tool assembly shown in FIG. 9, illustrating another position of the driven end angularly displaced from the drive end.

Now referring to FIGS. 9-11, there is illustrated the articulation that is permitted of shaft driven end 26 of the drive tool assembly 10 relative to the shaft drive end 24 where the driven end 26 is positioned on the flexible shaft 38 to allow displacement of the driven end portion 26 in an arcuate path along longitudinal axis 58 of the shaft 36. Rotation from the tee-handle 28 is transmitted by the shaft 36 to the flexible shaft 38 to the shaft driven end 26. Rotation, as shown in FIGS. 9 and 11, is transmitted in an arcuate path along the flexible shaft 38 to the meshing combination of the bevel drive gear 50 and the bevel gear 56 having the standard male/female driver 60. The torque transmission extends along an arcuate path from the shaft 36 to the gear housing 52 on the end of the flexible shaft 38 connected to the gear shaft 48 and bevel drive gear 50. A right angle drive connection is maintained between the meshing bevel gears 50 and 56. However, the engagement of the male/female driver 60 is not required to be in axial alignment with the drive shaft 36 at the point where the driver 60 engages a work piece 12, such as an end cap on the pipeline 22 as shown in FIGS. 18-20 and 21-23.

Figure 17:
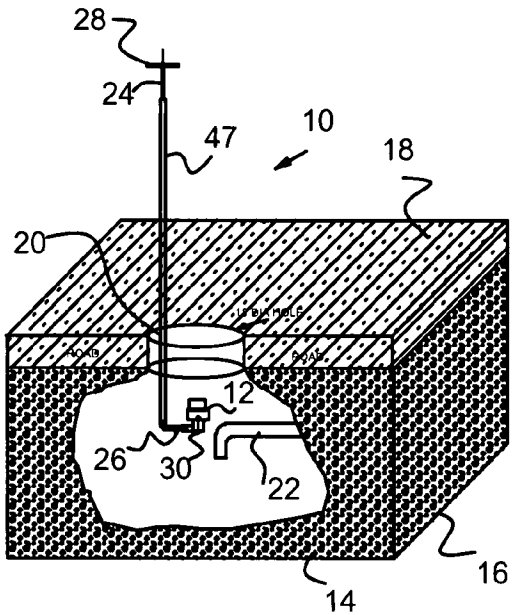
FIGS. 15-17 are isometric schematic views of the drive tool assembly in a keyhole operation, illustrating the driven end of the assembly in angular position to engage and remove the end cap from a pipeline where the end plug extends vertically downward from the pipeline.
Figure 16:
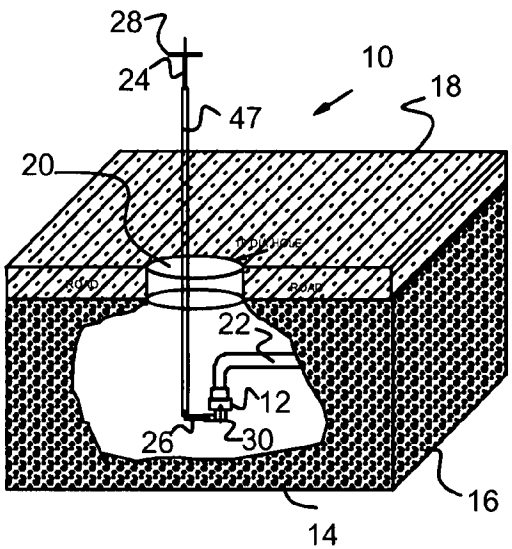
Figure 15:
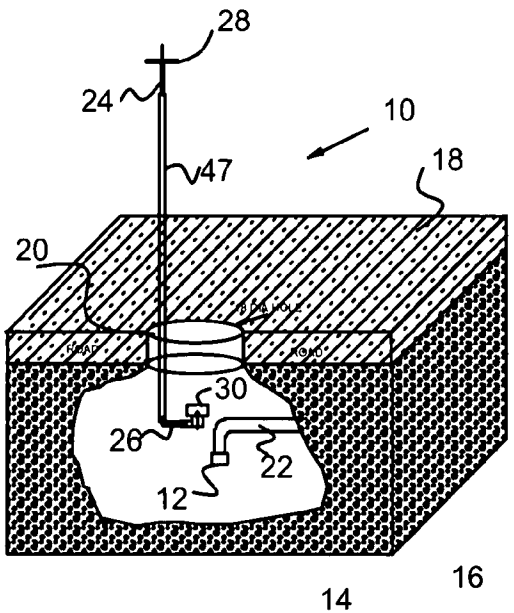
Figure 20:
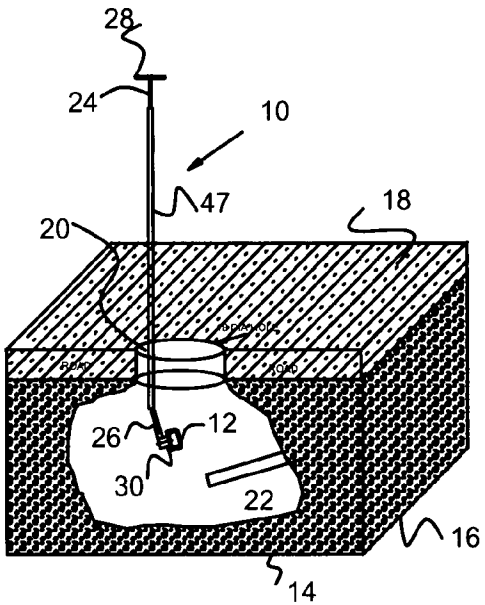
FIGS. 18-20 are isometric schematic views of the drive tool assembly in a keyhole operation, illustrating the driven end angularly positioned to engage and remove the end cap from a pipeline extending downwardly at an angle.
Figure 19:
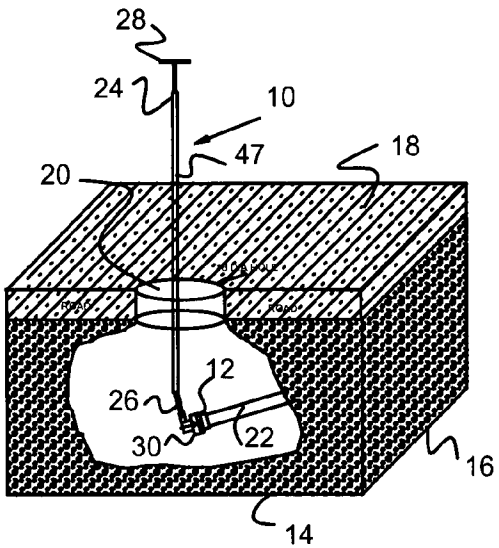
Figure 18:
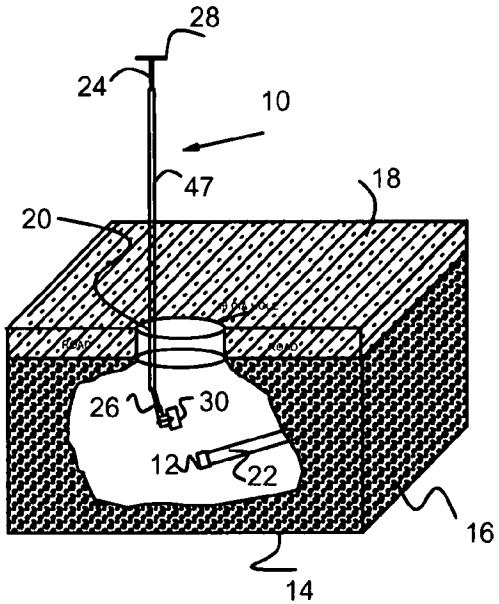
Figure 23:
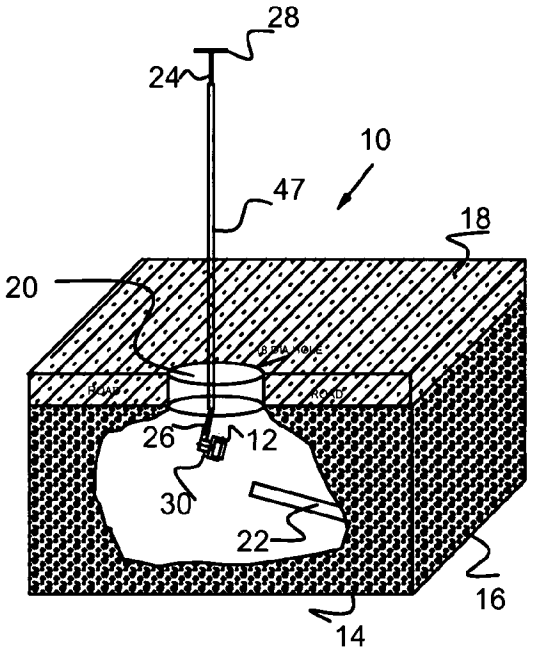
FIGS. 21-23 are schematic isometric views of the drive tool assembly in a keyhole operation, illustrating the driven end angularly positioned to engage and remove the end cap from a pipeline extending upwardly at an angle.
Figure 22:
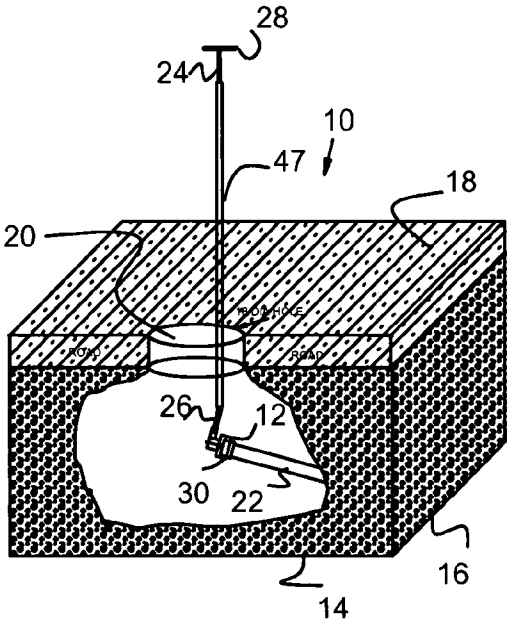
Figure 21:
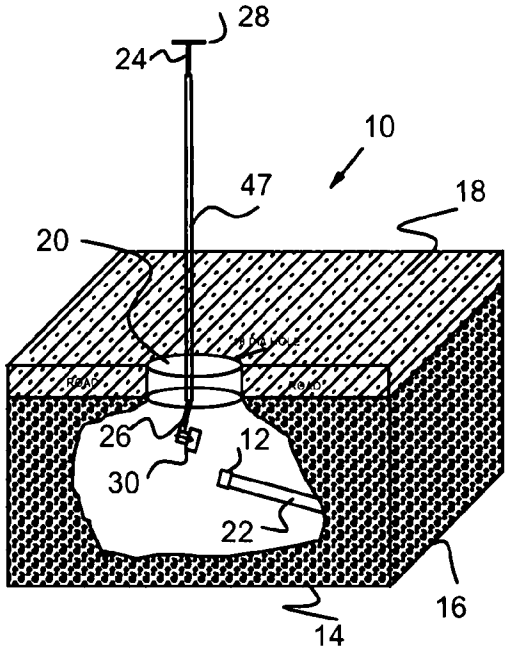

As illustrated in FIGS. 1-3 the tool 30, such as a ratchet drive, is connected at a right angle relation between the drive shaft and the longitudinal axis of the pipeline 22. A similar arrangement of a right angle relationship between the axis of the shaft 36 and the pipeline 22 is shown in FIGS. 15-17 where the tool 30 on the end of drive shaft 36 engages end cap 12 that extends vertically downward on a right angle extension of the pipeline 22. Consequently with the set ups disclosed in FIGS. 1-3 and 15-17, a right angle relation is maintained between the axis of the pipeline 22 and the axis of the drive shaft 36. Articulation or bending of the drive shaft 36 is not required for the tool 30 to engage the end cap 12 of the pipe 22, as shown in FIGS. 1-3 and 15-17. There are applications, as shown in FIGS. 18-20, where the pipeline 22 extends downwardly at an angle in the subterrarian formation 16 and where the pipeline 22 extends upwardly at an angle in the subterrarian formation 16, as shown in FIGS. 21-23. Articulation or bending of the tool 30 by its flexible connection on the end of drive shaft 36 is required in these applications.

As illustrated in FIG. 9, the tool 30 is articulated upwardly at an angle relative to the horizontally positioned longitudinal axis 58 of drive shaft 36. The articulation of the tool 30 is accomplished by provision of the flexible shaft 38 connected to the drive shaft end portion 46. As discussed above and illustrated in FIG. 3, the flexible shaft 38 may be replaced by the universal joint 40. With both connecting devices, the tool 30 is capable of being displaced from axial alignment with the shaft 36 to permit oscillating movement of the bevel gear driver 60 to engage a fixture which is not positioned in a right angle relationship with the drive shaft 36. Again this relationship is illustrated in FIGS. 18-20 and FIGS. 21-23. Also it is important to note that while articulation of the driven end 26 is permitted relative to the drive end 24 of the assembly 10, a right angle drive connection is maintained within the gear housing 52 by the meshing bevel gears 50 and 56 for transmission of rotation from the shaft 36 along the flexible shaft 38 to the driver 60.

In comparison with the embodiment shown in FIG. 9, the embodiment shown in FIG. 11 illustrates the tool 30 on the driven end 26 articulated or bent in an arcuate path downwardly below the horizontally positioned shaft longitudinal axis 58. With this arrangement the driver 60 engages a work piece which is not in a right angle relationship with the drive shaft 36. The position of the tool 30 shown in FIG. 11 corresponds to the position of the tool 30 engaging the end cap 12 of the pipeline 22 shown in FIGS. 21-23. It should be understood that FIGS. 9 and 11 illustrate only two articulated or oscillated positions of the tool 30 on the end of the drive shaft 36. A substantial number of articulated positions are permitted by the degree of bending permitted by supporting the tool 30 by the flexible shaft 38 on the drive shaft 36. As noted above for purposes of clarity of illustration, the link arms 54 supporting the gear housing 52 on the shaft housing 47 have been deleted from FIGS. 9-11 for purposes of clarity of illustration.

Figure 12:
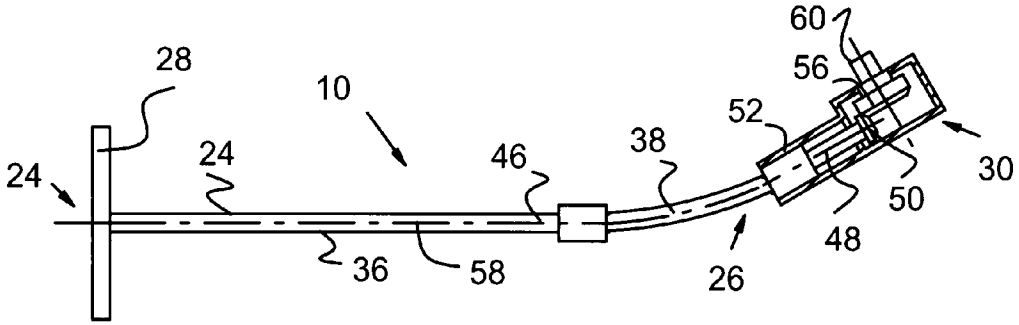
FIG. 12 is a top plan sectional view of another embodiment of the drive tool assembly, illustrating a rigid shaft having a flexible portion for angularly displacing a drive tool on the driven end of the shaft from the drive end of the shaft.
Figure 13:
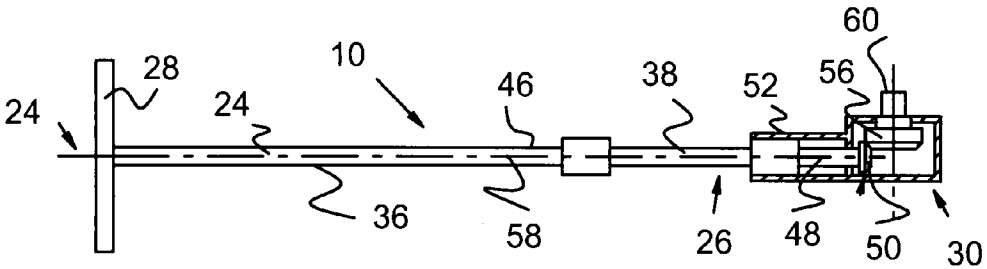
FIG. 13 is a top plan sectional view of the drive tool assembly shown in FIG. 12, illustrating the flexible portion of the shaft axially aligned with the drive end of the shaft.
Figure 14:
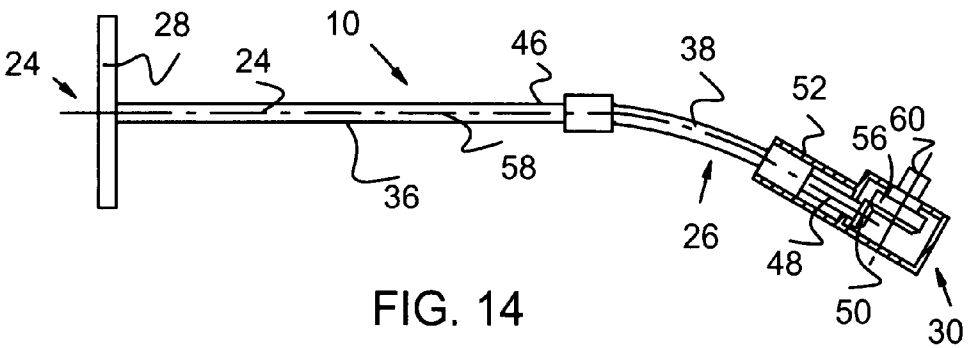
FIG. 14 is a top plan sectional view of the drive tool assembly shown in FIG. 12, illustrating further angular positioning of the flexible portion of the shaft relative to the drive end of the shaft.

In the embodiment of the drive tool assembly 10 shown in FIGS. 12-14, the drive shaft housing 47 and the link arms 54 are not required in the connection of the shaft 36 by the flexible shaft 38 to the tool 30. As with the embodiment shown in FIGS. 9-11, the drive shaft 36 is a rigid member and is nonrotatably connected to the flexible shaft 38 or in the alternative to the universal joint 40 shown in FIG. 7. The flexible shaft 38 is nonrotatably connected, as above described, to the gear shaft 48 and bevel drive gear 50 meshing with the bevel gear 56 to transmit rotation to the driver 60. The meshing components of the bevel gears 50 and 56 are rotatably supported within the gear housing 52 that is connected to the end of flexible shaft 38. The gear housing 52 remains stationary as rotation is transmitted from the flexible shaft 38 through the meshing bevel gears 50 and 56 to the driver 60. With this arrangement rotation is transmitted from the drive end 24 along the longitudinal axis 58 of the shaft 36 to the driven end 26.

In the embodiment of the drive tool assembly 10 shown in FIGS. 12-14, neither the housing 47 nor the support link arms 54 are needed. The tool driven end 26 articulates about the longitudinal axis 58 of shaft 36 to allow bending of the tool 30 as rotation is transmitted from the drive end 24 to the driven end 26. In FIG. 12, upward bending or articulation of the driven end 26 is permitted relative to the horizontally positioned longitudinal axis 58 of shaft 36. FIG. 14 illustrates downward articulation or bending of the driven end 26 relative to the horizontally positioned longitudinal axis 58 of shaft 36.

As shown in FIGS. 18-20, the pipeline 22 extends downwardly at an angle in the subterrarian formation 16. A right angle relation does not exist between the vertically extending shaft 36 and the pipeline 22. However, with the present invention of articulating the tool 30 on the end of shaft 36, the tool 30 is displaced from the vertical axis of the shaft 36 to engage the end cap 12 on the pipeline 22. FIG. 18 illustrates the initial positioning of the drive tool 10 through the opening 20 and downwardly into the cavity 14 where the downwardly extending pipeline 22 is positioned. As illustrated in FIG. 19 by articulating the tool 30 on the end of the shaft 36, the tool 30 engages the end cap 12 where the vertical axis of the shaft 36 is not in a right angle relationship with the longitudinal axis of the pipeline. With the provision of the flexible shaft 38, the tool 30 is articulated to a position displaced from the vertical axis of the shaft 36 to engage the end cap 12 on the pipeline 22. Once the tool 30 is drivingly connected to the end cap 12, the tee-handle 28 is rotated to remove the end cap 12 from the end of the pipeline 22. FIG. 22 illustrates the end cap 12 removed from the pipeline 22 and connected to the tool 30 for removal out of the cavity 14 and opening 20.

FIGS. 21-23 show a similar arrangement for operating the tool assembly 10, as shown in FIGS. 18-20. As shown in FIG. 21, the pipeline 22 with the end cap 12 thereon extends upwardly at an angle from the horizontal in the subterranean formation. The tool assembly 10 is lowered through the opening 20 into the cavity 14 with the tool 30 articulated in a position on the end of the shaft 36 to drivingly engage the end cap 12. FIG. 22 illustrates the tool 30 connected to the end cap 12 to remove it from the pipeline 22. Rotation of the tee-handle 28 transmits torque from the shaft 36 through the flexible shaft 38 to the driver 60 of the tool 30. The handle 28 is rotated until the cap 12 is disengaged from the pipeline 22. Once disengaged, the cap 12 on the end of the tool 30 is raised with the tool assembly 10 out of the cavity 14 through the opening 20. It should be understood FIGS. 18-20 and FIGS. 21-23 illustrate only two examples of the relative positioning of the tool 30 on the end of the drive shaft 36. Any number of positions are available by articulation of the tool 30 on the end of the tool assembly 10 by bending of the flexible shaft 38. This enables a driving connection of the tool 30 to the fixture on the pipeline without requiring a right angle relationship between the axis of the drive shaft 36 and the axis of the pipeline.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A drive tool assembly comprising:

an elongated rigid drive shaft having a drive end portion and a driven end portion with a longitudinal axis extending there between, means for transmitting torque, a flexible member connecting said drive shaft driven end portion to said torque transmitting means for transmission of torque from said drive shaft drive end portion through said drive shaft driven end portion and said flexible member to said torque transmitting means, said flexible member nonrotatably connected to said shaft driven end for articulation of said torque transmitting means relative to the shaft longitudinal axis, and said flexible member supporting said torque transmitting means on said drive shaft for displacement in an arcuate path relative to said drive shaft driven end portion.

2. A method for performing operations in a limited space work area comprising the steps of, extending a rigid shaft along a longitudinal axis into a limited space work area with the shaft drive end positioned outside of the limited space work area and the shaft driven end positioned in the limited space work area, nonrotatably connecting a flexible member to the shaft driven end for displacement from the shaft longitudinal axis in an arcuate path, drivingly connecting a torque transmitting device to the flexible member, supporting the torque transmitting device by the flexible member on the shaft driven end for arcuate movement relative to the shaft longitudinal axis, rotating the shaft drive end to transmit rotation from outside of the limited space work area to the shaft driven end and through the flexible member to the torque transmitting device in the limited space work area, and displacing the flexible member in an arcuate path as rotation is transmitted from the shaft through the flexible member to the torque-transmitting device in the limited space work area.

3. A drive tool for operating in a confined space comprising, an elongated rigid shaft extending longitudinally from a drive end positioned outside of the confined space to a driven end positioned within the, confined space, a flexible member nonrotatably connected to said shaft driven end positioned within the confined space for displacement from the shaft longitudinal axis in an arcuate path in the confined space relative to said shaft drive end positioned outside the, confined space, torque transmitting apparatus drivingly connected to said flexible member and movable with said flexible member in an arcuate path relative to said shaft drive end, and said shaft drive end transmitting rotation to said shaft driven end in the confined space through said flexible member along the arcuate path to said torque transmitting apparatus.

4. A drive tool assembly as set forth in claim 1 in which:

said rigid drive shaft includes a tubular housing.

5. A drive tool assembly as set forth in claim 1 which includes:

means for supporting said flexible member on said drive shaft driven end portion.

6. A drive tool assembly as set forth in claim 1 in which:

said torque transmitting means includes a plurality of bevel gears drivingly connected to said shaft driven end portion.

7. A drive tool assembly as set forth in claim 1 which includes:

said drive shaft driven end portion being non-rotatably connected through said flexible member to a ratchet driver.

8. A drive tool assembly as set forth in claim 1 which includes:

said drive shaft driven end portion being non-rotatably connected through said flexible member to a socket driver.

9. A drive tool assembly as set forth in claim 1 which includes:

said drive shaft driven end portion being non-rotatably connected to a universal joint.

10. A method for performing operations in a limited space work area as set forth in claim 2 which includes:

providing meshing bevel gears to drivingly connect the torque transmitting device through the flexible member to the shaft driven end.

11. A method for performing operations in a limited space work area as set forth in claim 2 which includes:

providing a pair of link arms to support the torque transmitting apparatus on the shaft driven end.

12. A method for performing operations in a limited space work area as set forth in claim 2 which includes:

providing a device for manipulating the shaft outside of the limited space work area.

13. A method for performing operations in a limited space work area as set forth in claim 2 which includes:

mounting a gear housing on the torque transmitting device, and connecting the shaft driven end through the flexible member to the gear housing.

14. A method for performing operations in a limited space work area as set forth in claim 2 which includes:

engaging a fixture with a universal joint in the limited space work area at an angle perpendicular to the vertical axis.

15. A method for performing operations in a limited space work area as set forth in claim 2 which includes:

engaging a fixture with a socket driver in the limited space work area at an angle displaced from an angle perpendicular to the fixture.

16. A drive tool as set forth in claim 3 in which:

said torque transmitting apparatus includes meshing bevel gears to transmit rotation from said shaft driven end through the flexible member to the work piece.

17. A drive tool as set forth in claim 3 in which:

said shaft driven end is connected through the flexible member to a plurality of meshing bevel gears, and said torque transmitting apparatus includes a gear housing rotatably supporting said meshing bevel gears.

18. A drive tool as set forth in claim 3 which includes:

said shaft driven end portion being non-rotatably connected to a universal joint head.

19. A drive tool as set forth in claim 3 which includes:

said shaft driven end portion being connected through the flexible member to a ratchet driver.

20. A drive tool as set forth in claim 3 which includes:

said shaft driven end portion being connected through the flexible member to a socket driver.

* * * * *